United States Patent [19]

Heine

[11] 3,983,710

[45] Oct. 5, 1976

[54] DEVICE FOR SEALING A ROOF OF AN EXCAVATION

[75] Inventor: Heinrich Heine, Duisburg, Germany

[73] Assignee: Rheinstahl AG, Germany

[22] Filed: Oct. 28, 1975

[21] Appl. No.: 626,325

[30] Foreign Application Priority Data

Oct. 31, 1974 Germany ..... 2451764

[52] U.S. Cl. ..... 61/45 D

[51] Int. Cl.[2] ..... E21D 15/44

[58] Field of Search ..... 61/45 D, 63; 299/31, 299/33; 248/357; 91/170 MP; 160/93, 94; 312/7 TV, 7 R

[56] References Cited

UNITED STATES PATENTS

| | | | |
|---|---|---|---|
| 2,311,413 | 2/1943 | Persson | 160/94 X |
| 3,921,409 | 11/1975 | Blumenthal | 61/45 D |

FOREIGN PATENTS OR APPLICATIONS

| | | | |
|---|---|---|---|
| 1,061,071 | 3/1967 | United Kingdom | 61/45 D |

*Primary Examiner*—Dennis L. Taylor
*Attorney, Agent, or Firm*—McGlew and Tuttle

[57] ABSTRACT

A device for sealing a roof of an excavation, such as a mine shaft, including a wide surface support member or cave-in shield, which is adapted to be supported in the excavation at an angle to the roof. An open top wide surface roof cap structure is pivoted to the upper end of the support member and it comprises a plurality of nested substantially U-shape members having widely spaced apart legs which are pivoted to the upper end of the support member and which extend downwardly in the form of a shutter or bellows to the support member. The widest one of the U-shape members is formed as an extension of the horizontal portion and the intermediate ones are disposed at separate respective angles closing the space between the cap and the support member.

4 Claims, 3 Drawing Figures

DEVICE FOR SEALING A ROOF OF AN EXCAVATION

FIELD AND BACKGROUND OF THE INVENTION

This invention relates in general to excavation devices and, in particular, to a new and useful device for sealing a roof of an excavation which comprises a wide surface cave-in shield support member which is adapted to be supported in the excavation at an angle to the roof and a cap which is pivoted on the upper end of the support member and which includes one end formed with a bellows-like construction which extends downwardly to the support member.

DESCRIPTION OF THE PRIOR ART

Known devices, referred to as cave-in shields, are used for mining seam deposits and, in operation, they rest against a sill beam and have at their end turned toward the face of the workings, a hinged roof cap. This cap extends from the hinge both in the advance and in the rearward direction and it includes a part overlying the shield in the direction of the filling area so that a wedge-like space is formed between the cap and the supporting member which varies in accordance with the angle at which the cap is disposed in relation to the roof which it is supporting. A disadvantage of this structure is that rock bits tend to get caught in the open space between the cap and the support structure so that the cap cannot be angled so as to apply against the roof wall with sufficient pressure.

Attempts have been made to fill the space between the cap and the support member with an elastic material, such as a foam material. However, such materials have not proved sufficiently resilient to permit unhindered operation of the cap. It is also known to provide the parts of the hinge connection with curved metal sheets which are aligned with the edges of the shield in order to prevent the rock bits from passing into the open space. In such a case, it is disadvantageous that the supported area is undercut, that is, the specific surface pressure on the parts forming the hinge of the cave-in shield and the cap is substantially higher than the pressure on the other parts. In addition, the design of the hinge is thereby affected unfavorably.

SUMMARY OF THE INVENTION

The present invention provides a seal designed to obtain an effective and rugged construction and, at the same time, provides a uniform loading supporting surface of both the cave-in shield and the roof cap. With the inventive construction, the roof cap is pivoted to the upper end of the supporting member or wide surface cave-in shield, and with the invention, it is possible to obtain a satisfactory angle of slide for the broken-up waste material in the extraction of thin seams.

In accordance with a preferred embodiment of the invention, the cap includes one end which makes an angle with the support shield and which is provided with a shutter-like or bellows-like structure which extends from the end of the cap in an arc downwardly to the shield. The structure is formed by a formation of substantially U-shape legs which nest together and into the undersurface of the cap and which includes a lowermost and smallest bracket which is attached to the support member and an uppermost and largest bracket which is carried by the cap. The intermediate U-shape members form a fan-like structure with individual ones being at distinct angles between the support structure and the cap. In order to enable each U-shape member to take the next adjacent member along with it when the angle of the cap in relation to the support member is opened, the invention provides that the upper and lower boundary edges of the U-shape members include stops which interengage and which project alternately to the outside or to the inside so that they pick up the next adjacent member when contact is made to carry it along during the movement and also permits collapsing movement and nesting of the legs during a closing movement.

Accordingly, it is an object of the invention to provide a device for sealing the roof of an excavation which comprises a wide surface support member or cave-in shield which is adapted to be supported at the excavation at an angle to the roof and including a wide surface roof cap pivoted to the upper end of the support member and having a plurality of nested substantially U-shape members adjacent one end which have widely spaced apart legs which are pivoted to the support member and which form a fan-like closure between the cap and the support member which may open or close in dependence upon the angle of the cap with the support member.

A further object of the invention is to provide a device for sealing a roof structure which is simple in design, rugged in construction, and economical to manufacture.

The various features of novelty which characterize the invention are pointed out with particularity in the claims annexed to and forming a part of this disclosure. For a better understanding of the invention, its operating advantages and specific objects attained by its uses, reference should be had to the accompanying drawings and drawings and descriptive matter in which there is illustrated a preferred embodiment of the invention.

DESCRIPTION OF THE PREFERRED EMBODIMENT

Figure 1:
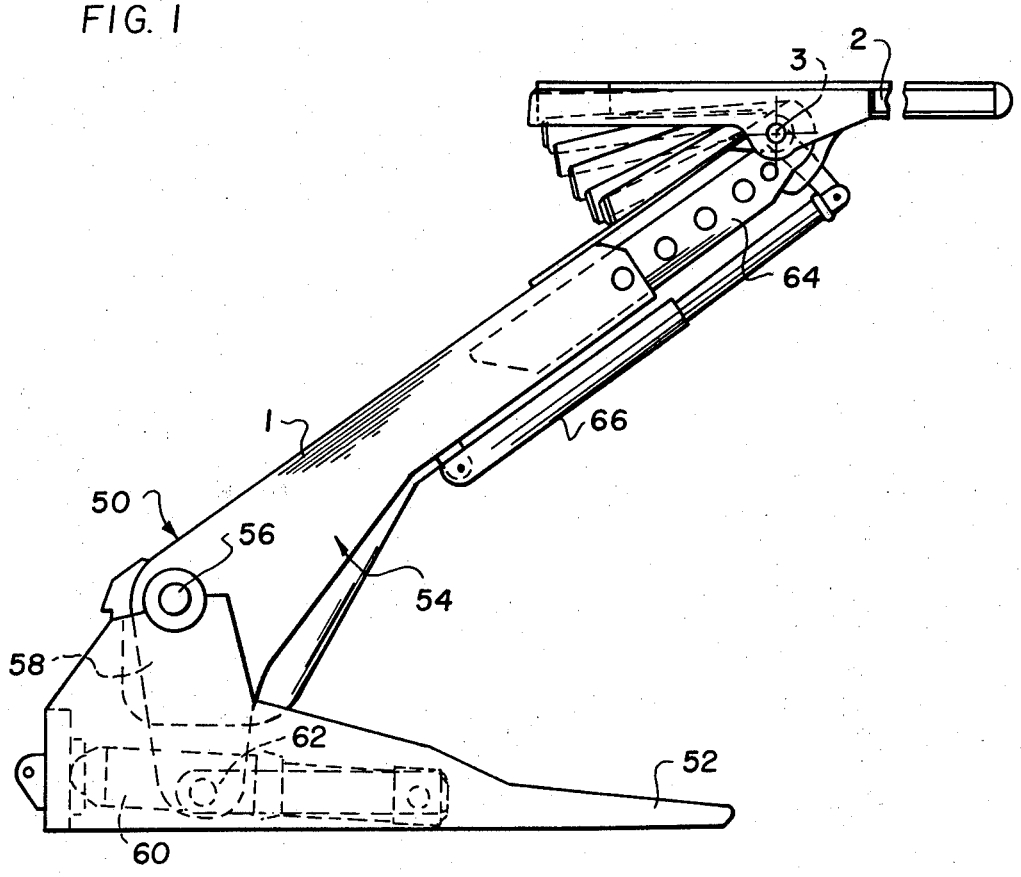
FIG. 1 is a side elevational view of a device for sealing a roof of an excavation constructed in accordance with the invention.

Referring to the drawings in particular, the invention embodied therein in FIG. 1, comprises a device for sealing a roof of an excavation, such as a mine shaft, which comprises a support member or structure, generally designated 50, which includes a foot 52 which is adapted to be supported on the floor or beam of an excavated structure. A double-arm lever member, generally designated 54, is pivoted on the support 52 at 56, and it includes one arm portion 58 which is connected to a fluid piston and cylinder combination 60 through a link 62 so that a second arm portion 1, which forms a wide surface cave-in shield, may be positioned at an angle in respect to the excavation. The cave-in shield portion 1 is also provided with an extension 64 which may be slid inwardly or outwardly and which forms an upper extension of the cave-in shield 1. A cap, generally designated 2, is pivoted at pivot 3 to the outer end of the cave-in shield 1 at the location of the extension portion 64. The cap 2 may be pivoted or swung about the pivot 3 by means of a fluid drive motor 66 which is in the form of a piston and cylinder combination.

In accordance with the invention, one end of the cap, that is the end which makes an acute angle with support member 1, is made up of a plurality of nested U-shape members, generally designated 6, which form a closing fan-like structure or bellows between the top surface or stop ledge 5 of cap 2 and support member 1 or its extension 64.

Figure 2:
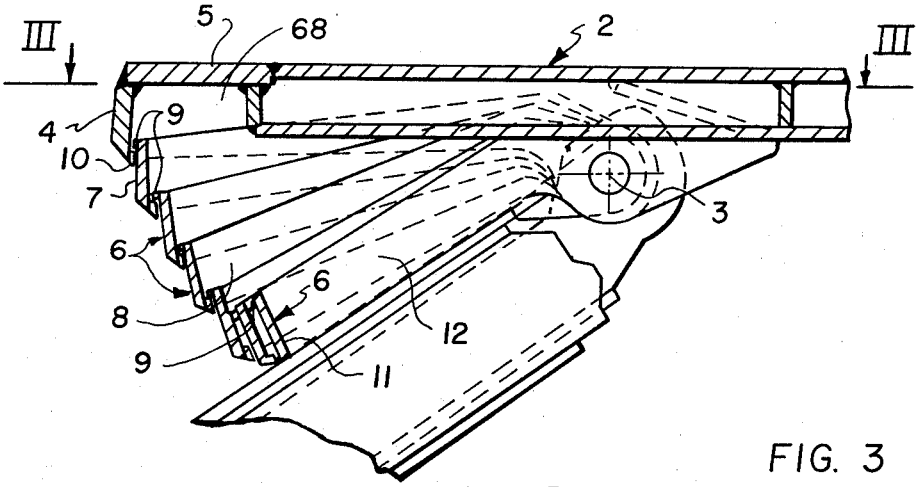
FIG. 2 is an enlarged partial longitudinal sectional view of the structure shown in FIG. 1.
Figure 3:
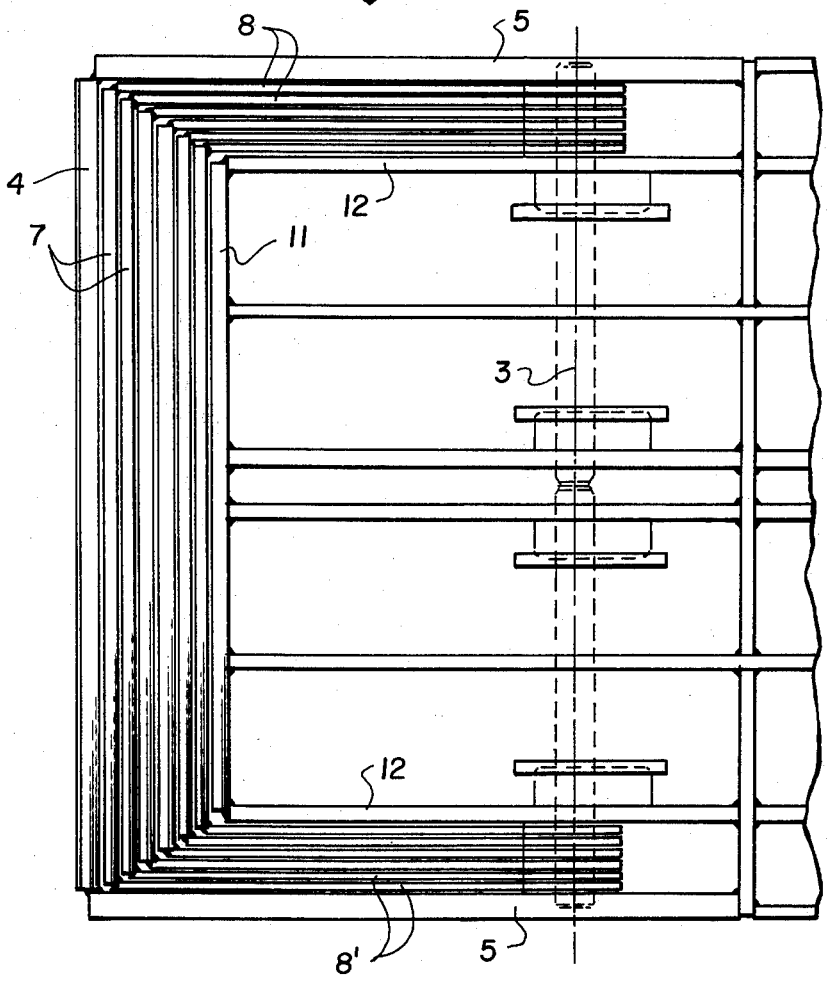
FIG. 3 is a partial horizontal sectional view taken along the line III—III of FIG. 2.

As shown in FIGS. 2 and 3, the cap 2 is formed with a downwardly opening recess 68 adjacent one end which is large enough to accommodate the closed end of each of the U-shape members 6 when the cap 2 is disposed at an elevation in respect of the support member in which it is substantially parallel to it. As shown in the drawings of FIG. 2, however, the cap may be disposed substantially horizontally, in which case, the individual U-shape members 6 fan outwardly and form a closed connecting structure between this end of the cap and support structure 1.

Each of the U-shape members is substantially rectangular and include side walls 8 and 8' and front walls 7. The roof cap 2 includes a front wall 4 which extends outwardly of all of the walls of the U-shape members 6. In accordance with a feature of the invention, interengageable means are provided between the front wall 4 of cap structure 2 and all of the individual U-shape support members which permit them to be spread apart in a fan-like manner but which prevent the complete severance of each from the next adjacent one. For this purpose, front wall 4 of cap 2 includes a lower stop ledge or projection which prevents the movement of a projection 9 on the upper edge of the next adjacent U-shape member from moving therepast, as indicated in the open position in FIG. 2. In a similar manner, each front wall 7 of U-shape members 6 includes a lower stop edge 10 and an upper stop edge or projection 9.

When the support member or cave-in shield 1 is elevated, the angle between the rear end of the roof cap 2 and shield 1 will increase. During this motion, the outwardly projecting stop ledges 9 consecutively apply by their undersides against the undersurfaces of the inwardly projecting stop ledges 10. The lowermost bracket is provided with only one upper stop ledge 9, and it is secured on its underside to the cave-in shield structure or support member 1. In the embodiment shown, the lower edges of the front strips 4 and 7 and the lower stop ledges 10 are bevelled in order to eliminate any tendency for rock bits to be retained on the shield structure and prevent the motion of the roof cap 2 relative to the support member 1. The lowermost U-shape member 6 which is secured to support member 1 is provided with a front wall 11 having only an outwardly projecting stop ledge 9 which is held in place by lateral projecting edges or strips 12.

While a specific embodiment of the invention has been shown and described in detail to illustrate the application of the principles of the invention, it will be understood that the invention may be embodied otherwise without departing from such principles.

What is claimed is:

1. A device for sealing a roof of an excavation, comprising a wide surface support member adapted to be supported in the excavation at an angle to the roof, and a wide surface roof cap pivoted to the upper end of said support member and comprising a rigid open top structure having on at least one end a plurality of nested substantially U-shape members, each having widely spaced apart legs, with ends pivoted to the upper end of said support member, and with the innermost one of said U-shape members being the smallest and being secured to said support member, the uppermost one being the largest and forming a part of said top structure of said roof cap, and the intermediate ones being disposed at separate respective angles forming a fan-like structure closing the space between said cap and said support member.

2. A device for sealing a roof of an excavation, according to claim 1, wherein at least some of said U-shape members have outwardly projecting upper stop ledges adjacent their upper edges and inwardly directed lower stop ledges adjacent their lower edges which interengage during outward opening movement of the adjacent end of said cap in respect to said support member whereby to spread the nested U-shape members apart.

3. A device for sealing a roof of an excavation, according to claim 2, wherein said U-shape members include front walls having lower edges which are bevelled inwardly toward the next innermost U-shape member.

4. A device for sealing a roof of an excavation, according to claim 1, wherein said U-shape members are substantially rectangular and include spaced apart leg portions and a closing front wall portion between said leg portions, said cap having a top wall forming a ledge with a recess below said ledge into which said U-shape member front walls engage, said cap having an outer front wall with a lower stop ledge extending inwardly, the outermost one of said U-shape members having a front wall with an outwardly extending stop ledge engageable with the stop ledge of said cap when said U-shape member is extended outwardly at an angle in respect to said cap.

* * * * *